US005363988A

United States Patent [19]

Saxton et al.

[11] Patent Number: 5,363,988

[45] Date of Patent: Nov. 15, 1994

[54] FUEL DISPENSER CONTROLLED IN DEPENDENCE ON AN ELECTRICAL SIGNAL FROM A GAS DETECTOR OF THE DISPENSER

[75] Inventors: John E. Saxton, Ingatestone; Michael L. Jennings, Billericay; Jack F. Bartlett, Mayland; James R. Dormer, Rochford; Peter D. G. Massingberd-Mundy, Billericay, all of United Kingdom

[73] Assignee: Gilbarco Limited, Essex, United Kingdom

[21] Appl. No.: 26,452

[22] Filed: Mar. 3, 1993

Related U.S. Application Data

[63] Continuation-in-part of Ser. No. 940,243, Sep. 8, 1992, abandoned.

[30] Foreign Application Priority Data

Sep. 13, 1991 [GB] United Kingdom ..... 9119605

[51] Int. Cl.[5] ..... B67D 5/30

[52] U.S. Cl. ..... 222/14; 222/1; 222/40; 222/59; 222/72; 222/75

[58] Field of Search ..... 222/1, 14, 23, 40, 51, 222/52, 59, 72, 75, 189; 137/554; 200/82 E, 83 J, 83 R

[56] References Cited

U.S. PATENT DOCUMENTS

| | | | |
|---|---|---|---|
| 2,276,838 | 3/1942 | Grise | 222/72 X |
| 2,353,206 | 7/1944 | Waugh | 222/72 |
| 2,779,503 | 1/1957 | Wright et al. | 222/72 |
| 3,081,627 | 3/1963 | Reed et al. | 222/72 X |
| 3,327,079 | 6/1967 | Widl | 200/82 E X |
| 4,020,861 | 5/1977 | Shihabi | 137/100 |
| 4,611,729 | 9/1986 | Gerstenmaier et al. | 222/75 |
| 4,962,831 | 10/1990 | Dundas | 200/82 E X |
| 4,979,374 | 12/1990 | Janssen et al. | 55/165 |
| 5,238,154 | 8/1993 | Zuriel | 222/189 |

FOREIGN PATENT DOCUMENTS

| | | | |
|---|---|---|---|
| 4852272 | 5/1974 | Australia . | |
| 313095 | 1/1974 | Austria . | |
| 522869 | 3/1956 | Canada | 222/72 |
| 0357513 | 3/1990 | European Pat. Off. . | |
| 0473818 | 3/1992 | European Pat. Off. . | |
| 2530168 | 1/1977 | Germany | 200/83 R |
| 200159 | 2/1939 | Switzerland | 200/83 R |

*Primary Examiner*—Andres Kashnikow
*Assistant Examiner*—Joseph A. Kaufman
*Attorney, Agent, or Firm*—Spencer, Frank & Schneider

[57] ABSTRACT

This invention relates to an improved fuel dispenser comprising a gas detector responsive to the presence of gas within the fuel. The gas detector provides an electrical signal indicative of the presence or absence of gas to a computer which controls a valve, and thus the dispensing of fuel in dependence upon the signal received from the gas detector.

33 Claims, 4 Drawing Sheets

FUEL DISPENSER CONTROLLED IN DEPENDENCE ON AN ELECTRICAL SIGNAL FROM A GAS DETECTOR OF THE DISPENSER

CROSS-REFERENCE TO RELATED APPLICATION

This application is a continuation-in-part of application Ser. No. 07/940,243, filed Sept. 8th, 1992, now abandoned.

BACKGROUND OF THE INVENTION

This invention relates to a fuel dispenser and in particular but not exclusively to the type of dispenser common on service station fore-courts for dispensing diesel oil or petroleum for use in motor vehicles.

When fuel is dispensed it is nearly always metered for charging purposes. Because of the relatively high price and taxation levels of fuel, compared to other bulk liquids, stringent limits are laid down as to the accuracy with which the fuel must be metered. Contamination with gas, which term for the purposes of this specification including the claims includes vapour and/or air and other gases, results in inaccurate measurement of tile quantity of fuel dispensed. Contamination tends to occur during the pumping of fuel, especially diesel, whilst dispensing as this encourages vapourisation of the fuel and may induce air into the fuel through leaks in the system.

One way of overcoming the above problem is to incorporate a separator in a dispensing system upstream from the meter. This essentially comprises a closed tank in which the fuel passes through a wire gauze which tends to separate out the gas so that it can be vented off. Most fuel passes through to an outlet in the bottom of the separator and to the meter. The separator has to be of sufficient size to ensure adequate separation. This size is dependent upon the flow rate, viscosity and amount of contamination. These values can normally be calculated, but extremes of weather (fuel is more viscous in cold weather especially diesel oil), or faults in the system (for example air leaks in the suction pipe from the pump to a tank), cannot always be allowed for. Furthermore even under normal conditions the size of a separator can be prohibitive, especially in the case of more viscous fuels, and expensive centripetal separators may be necessary if metering of gas-free fuel is to be ensured.

Apparatus which attempts to solve the above problems is disclosed in Australian Patent No. 48522/72, in the name of Gilbarco Australia Limited. One embodiment of the invention disclosed in this earlier patent specification is illustrated in FIGS. 1 and 2 of the accompanying drawings.

In FIGS. 1 and 2 a dispensing system is illustrated which includes a gas separator 1 arranged such that gas entering the system is substantially drawn off through pipe 2, while substantially gas-free fuel passes via pipe 3 through valve 4 and meter 10 for dispensing. The pipe 2 passes through a venturi 5 and into a sump 6. Any fuel accumulating in sump 6 is returned by pipe 7 to the inlet of a pump unit (not shown). When gas-free fuel is passing along line 3 the venturi creates a reduction in pressure, hereinafter referred to as a vacuum, in chamber 8 shown in FIG. 2 which causes valve 4 to open. However should air be present, the vacuum is reduced and the valve 4 closes under the action of spring 9, shutting off the fuel for dispensing when gas is present, and therefore only permitting gas-free fuel to pass to the meter 10 which is monitored by a computer 11.

It has been found that employing a system as disclosed in FIGS. 1 and 2 is not an ideal solution to the problem as the system tends to hunt.

SUMMARY OF THE INVENTION

According to a first aspect of the present invention there is provided a fuel dispenser comprising a gas detector for producing an electrical signal in dependence upon the presence of gas in fuel flowing through the gas detector, and processing means for receiving the electrical signal and controlling the dispensing of fuel at least in part in dependence upon the electrical signal received. By employing such a dispenser it is possible to control the dispensing of fuel in any manner desired in response to said received signal. This can be employed to reduce or prevent hunting and provides flexibility of control, enabling the dispenser to be easily adapted to comply with different legislative conditions.

Preferably the dispenser further comprises a fuel separator including an inlet for receiving fuel and first and second outlets, wherein the first outlet is positioned so as to receive a greater proportion of gas than the second outlet and wherein the gas detector receives fuel from the first outlet and fuel for dispensing is received from the second outlet. This permits gas to be drawn off through the gas detector which enables fuel to be dispensed as normal if the gas drawn through the detector is below a preset level. If the gas content exceeds this preset level fuel dispensing can be stopped and the system purged by the gas passing through the detector. Also, by employing such a simple separator the concentration of air can be 20 times greater passing through the first outlet than passing through the second outlet. Fuel passing through the gas detector is advantageously recycled through the separator, preferably first flowing into a vented reservoir so that any gas can be vented off.

Fuel leaving through the second outlet of the separator preferably passes through a meter before being dispensed, such that only substantially gas free fuel is metered.

It is advantageous that the gas detector comprises a venturi device and that this comprises a first and second closed chamber separated by a movable member, an inlet and outlet in the first chamber forming a venturi device such that fuel passing through them produces a reduction in pressure in the first chamber, the second chamber being connected by a passage to the outlet of the detector. This enables the second chamber to be sealed from the atmosphere.

For volatile fuels the gas detector preferably includes a restriction in the outlet downstream from the connection to the passage. The inclusion of a restriction increases the sensitivity of the gas detector for a given flow rate since the pressure difference across the movable member is increased when no gas is present but relatively reduced when gas is present. Such enhanced sensitivity enables the dimension of the venturi device formed by the inlet and outlets in the first chamber to be arranged so as to reduce the reduction in pressure in the chamber which reduces the likelihood of vapourising the fuel. This is particularly useful for gas detectors operating in hot climatic conditions where fuel vapourisation is more likely.

Advantageously a metallic member is attached to the movable member such that the metallic member moves into and out of a magnetic field between a magnetic source and a magnetically sensitive switching element in the casing of the detector, for producing said electrical signal. This enables an output to be obtained through the casing of the gas detector without the need for an aperture in the casing.

The fuel dispenser may additionally comprise a nozzle through which fuel is dispensed, the nozzle being attached to the main body of the dispenser by a flexible hose, wherein the dispenser includes a cradle for the nozzle to be returned to when not in use, and a hose cock switch for transmitting a signal to the computer indicative of the presence or absence of the nozzle in the cradle. This enables the processing means to be adapted such that, once gas-free fuel has been detected after the nozzle has been removed from the cradle, the processing means causes a valve to open allowing fuel to be dispensed, and causes the valve to close if gas is again detected. The processing means may be set such that the valve remains closed until the nozzle has been returned to the cradle, or alternatively the processing means may be set so as to cause the valve to open again if gas-free fuel is again detected in a predetermined period after the initial closing of the valve, and if no gas-free fuel is detected in said period to cause the valve to remain closed until the nozzle has been returned to its cradle.

It is advantageous if the processing means records the duration for which gas is detected and uses this information to determine whether the fuel so far dispensed is within predetermined metrological limits for the amount of fuel so far dispensed in a transaction, and to then control the valve accordingly. This enables the dispenser to dispense fuel continuously during a transaction even though the fuel received by the dispenser may for a short duration contain a very high content of gas, thereby preventing the dispenser from hunting. The valve may also have more than one setting, permitting the dispensing rate to be reduced enabling the separator to cope with a higher percentage of gas in the fuel. This provides an alternative to completely shutting off the dispensing of fuel, which can be confusing to an operator of the dispenser.

Advantageously the processing means records the duration for which gas is detected and provides a warning if this exceeds a predetermined limit. This warning could take the form of a signal direct to a pump attendant and/or could provide some sort of flag within the dispenser to warn a service engineer that there is a problem.

In accordance with a second aspect of the invention there is provided a method of dispensing fuel.

BRIEF DESCRIPTION OF THE DRAWINGS

One embodiment of the invention will now be described by way of example only with reference to FIGS. 3 and 4 of the accompanying drawings of which.

DETAILED DESCRIPTION

Figure 1:
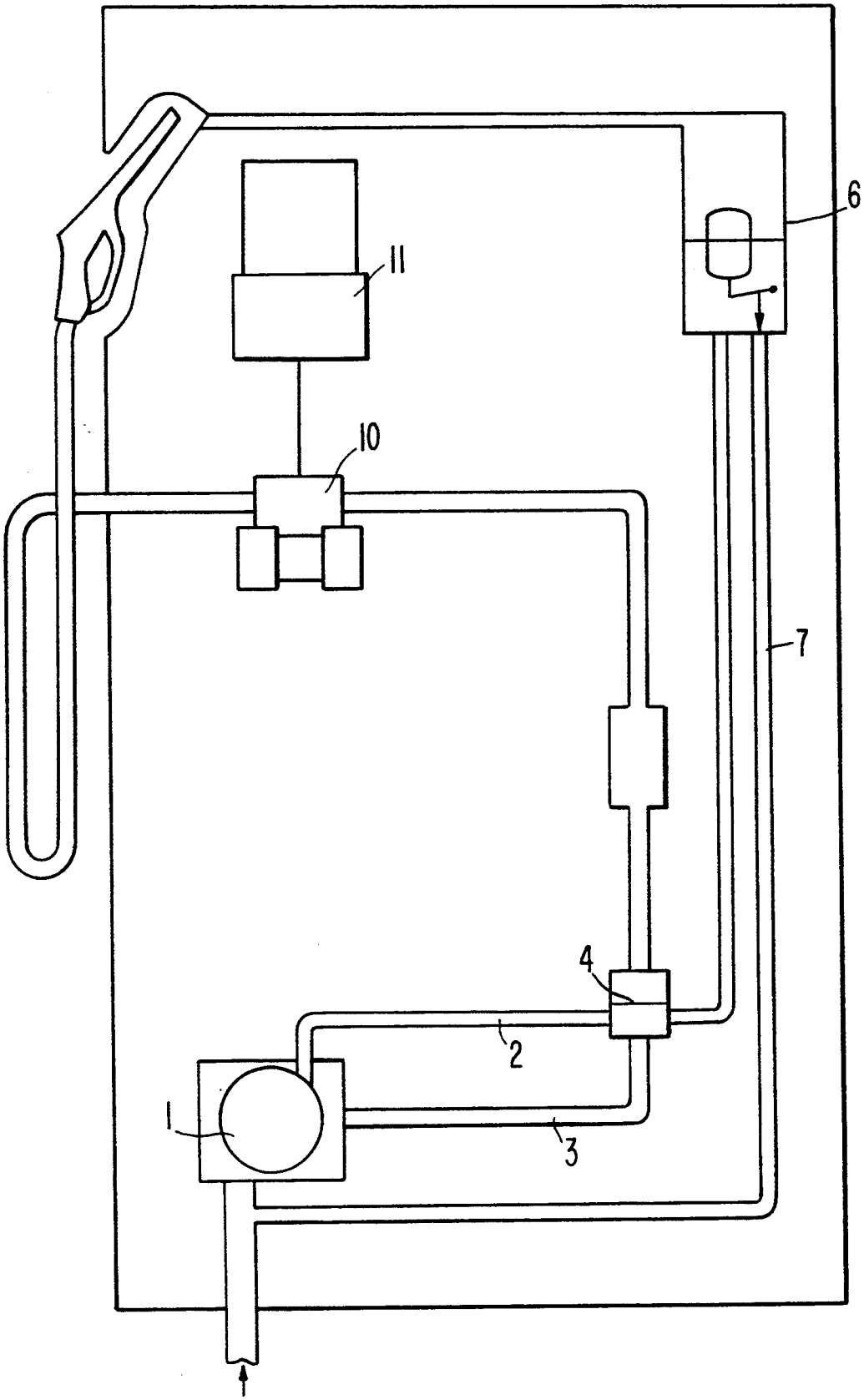
FIG. 1 PRIOR ART
FIGS. 1 and 2 illustrate a prior art dispensing system.
Figure 2:
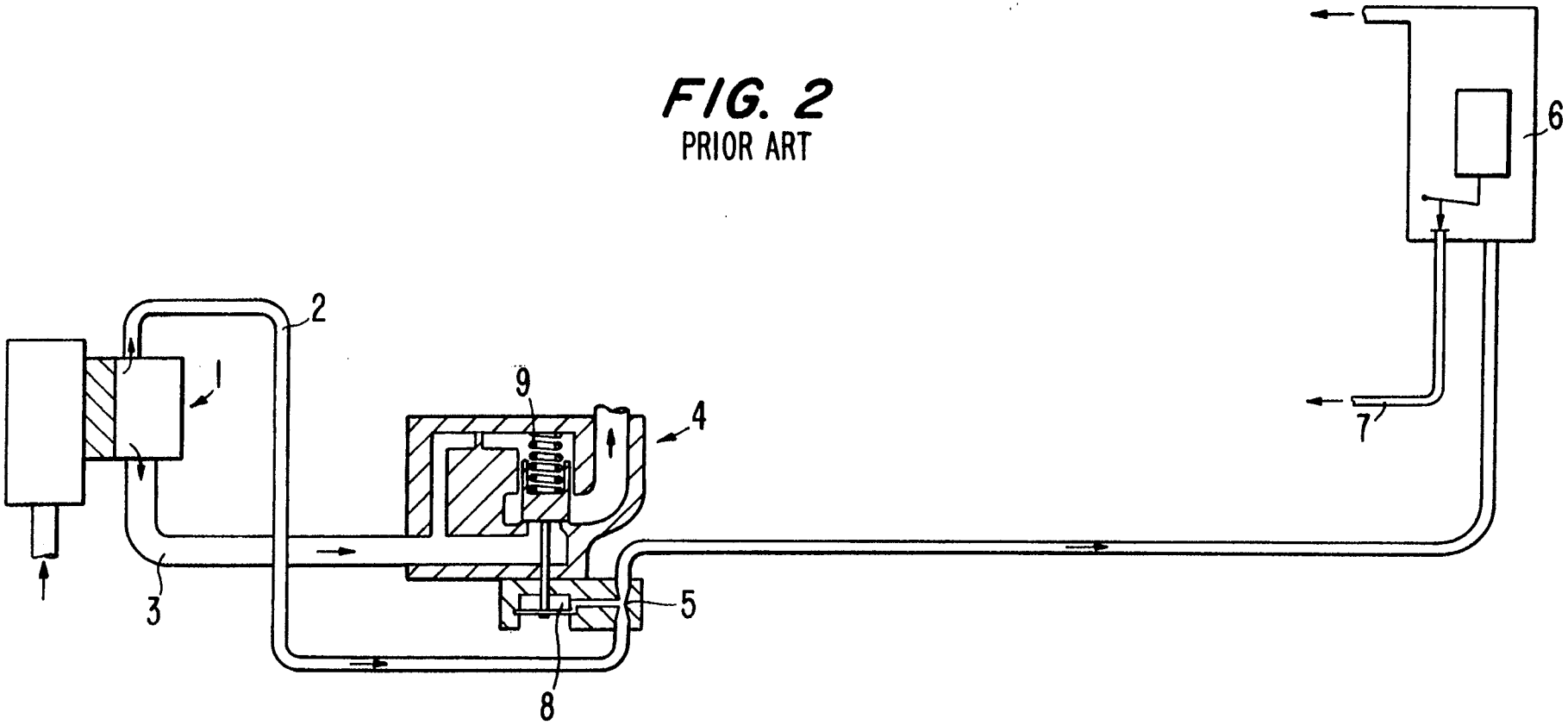
FIG. 2 PRIOR ART
Figure 3:
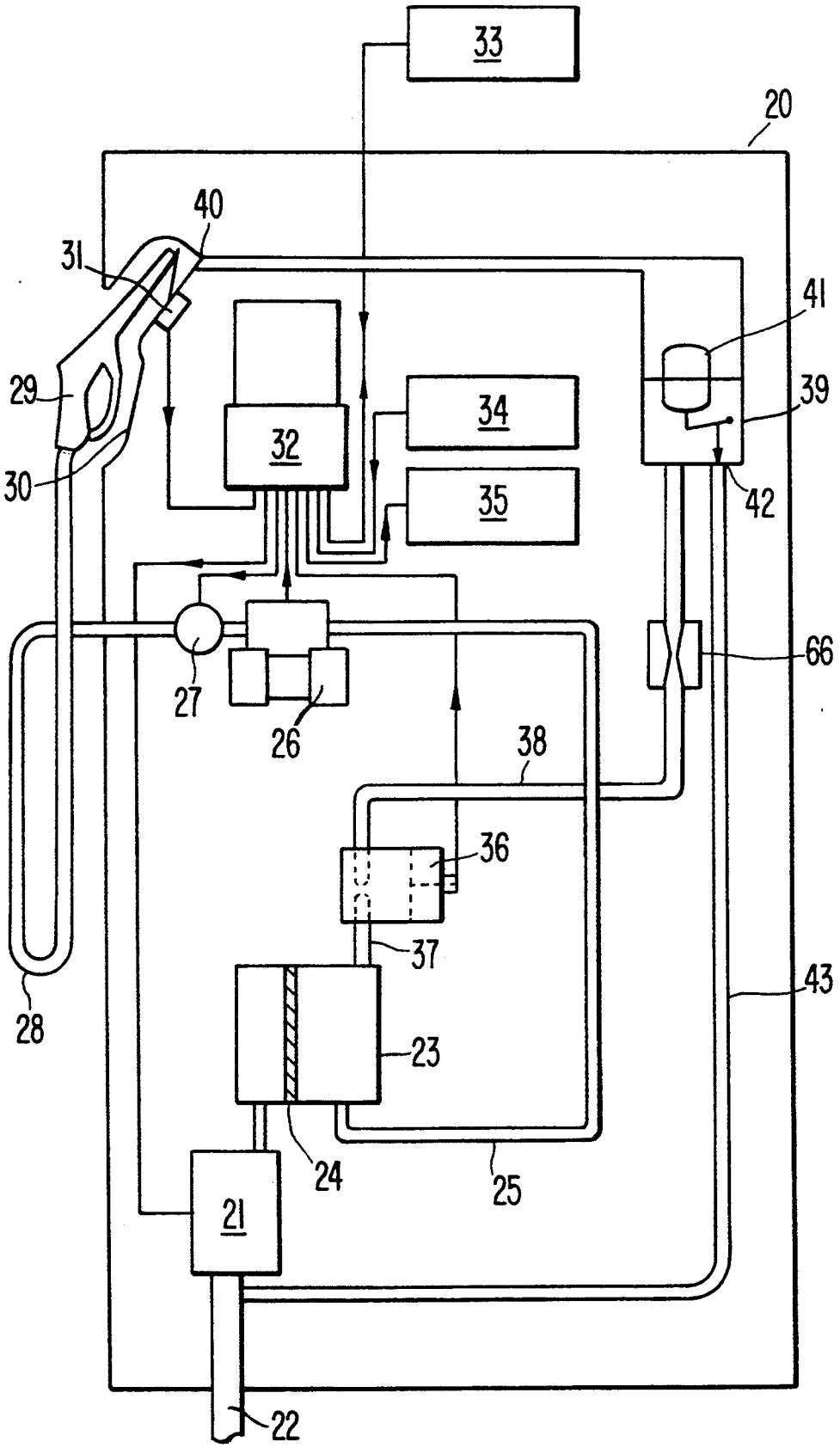
FIG. 3 schematically depicts a fuel dispenser in accordance with the present invention.

Referring to FIG. 3 the fuel dispenser 20 comprises a pump 21 for raising fuel from an underground tank via suction pipe 22 which is then fed to separator 23. In the separator 23 the fuel passes through a mesh 24 which encourages gases to separate out of the fuel. Substantially gas-free fuel is supplied through pipe 25 via meter 26, valve 27 and flexible hose 28 to nozzle 29 from where it is dispensed. The nozzle 29 is shown resting in its cradle 30 which incorporates a hose cock switch 31 which registers the presence of the nozzle 29 and transmits this information to a computer 32.

The computer 32 in addition to receiving information from the hose cock switch 31 also receives information from the meter 26, a remote console 33 controlled by the service station attendant, and user control panel 34. The computer 32 controls the pump 21 and the valve 27, and also provides information to a display 35. In addition to this the computer also receives information from a gas detector 36 which is illustrated in more detail in FIGS. 4A and 4B.

The gas detector 36 receives gas and fuel via a pipe 37 from the top portion of the separator 23 where most of the gas is accumulated. As is described in more detail below with reference to FIGS. 4A and 4B gas/fuel passing via pipe 37 through gas detector 36 passes through a venturi in the detector which causes a switch within the gas detector to open and close dependent on the amount of gas present. Fuel and gas passing through the detector is transmitted via pipe 38 to a sump 39 where the gas is vented off to the atmosphere via a breather 40 located in the nozzle cradle 30. The sump 39 includes a float 41 which, when the level of fuel within the sump 39 is high enough, raises valve 42 such that the fuel is drained via pipe 43 back to the inlet, 22.

Figure 4A:
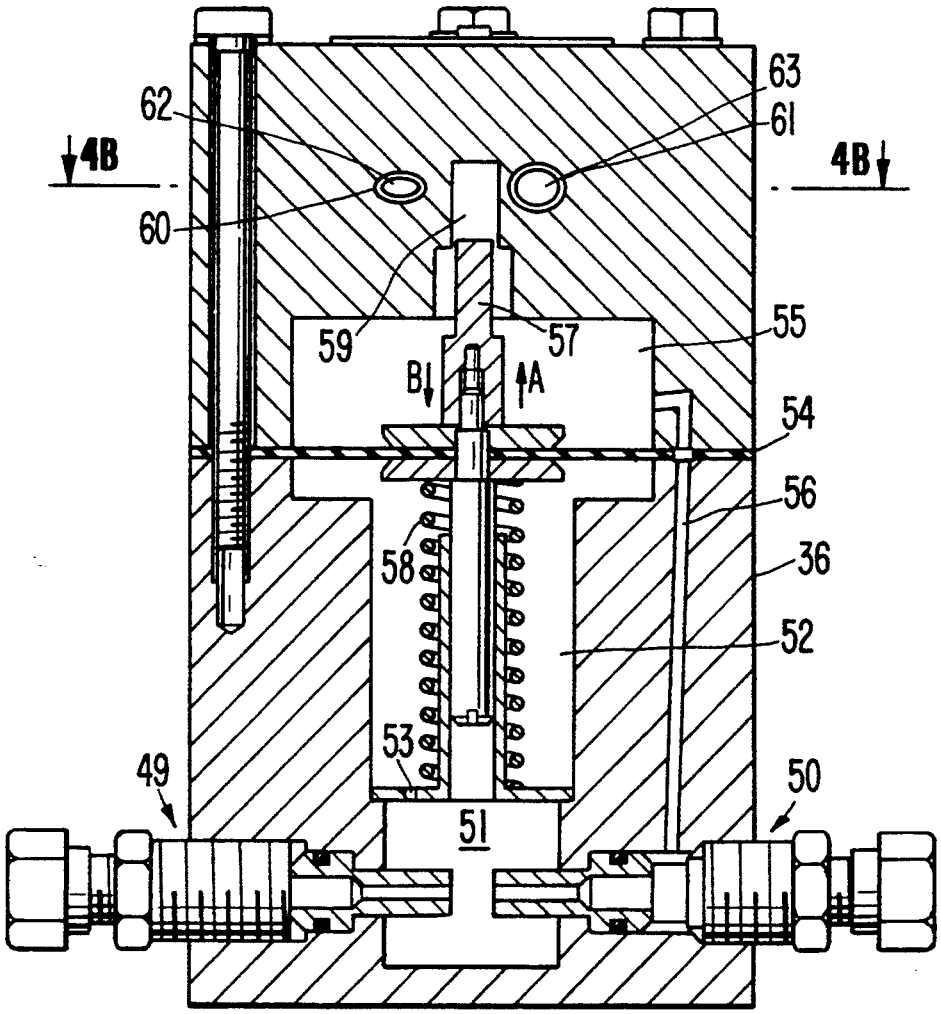
FIG. 4A is a cross-section through the gas detector of the fuel dispenser depicted in FIG. 3.
Figure 4B:
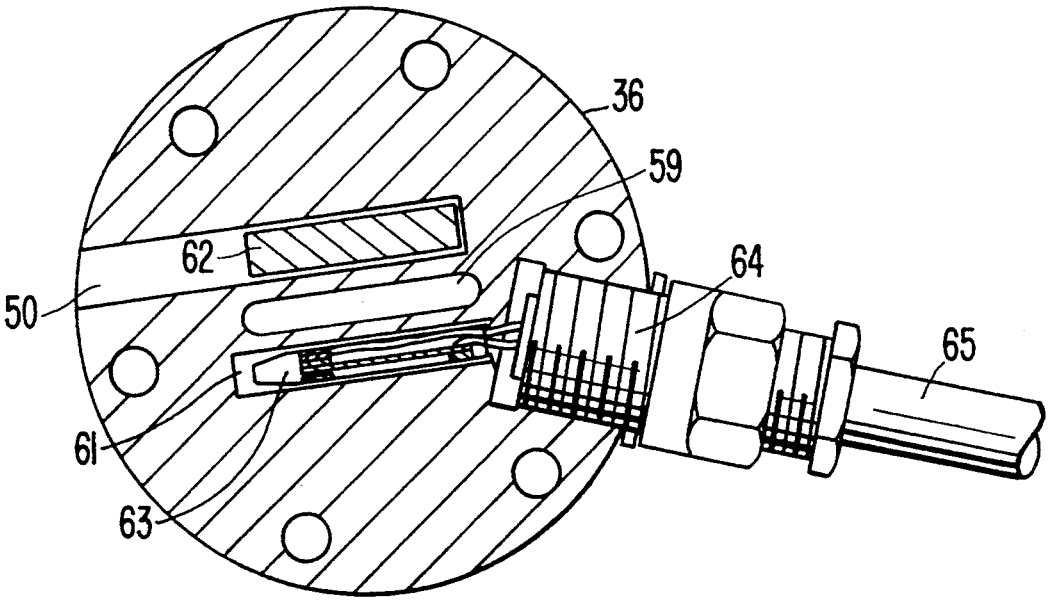
FIG. 4B is a cross-section along the line 4B—4B of FIG. 4A.

Referring to FIG. 4A the gas detector 36 of FIG. 3 comprises an inlet 49 and outlet 50 which are connected to pipes 37 and 38 of FIG. 3 respectively. The dimensions of the inlet and outlet are such that a venturi effect is generated in the region 51 causing pressure in a first chamber 52 to be reduced via the aperture 53, when fuel is flowing from the inlet 49 to the outlet 50. The chamber 52 is sealed by diaphragm 54 which also seals a second chamber 55. This second chamber 55 is connected via vent 56 to the outlet 50. Connected to the diaphragm 54 is a metallic member 57 which is biased in direction "A" by spring 58.

In operation fuel passing from the inlet 49 to the outlet 50 causes a reduction in pressure (hereinafter referred to as a vacuum) in the first chamber 52 which acts against the spring 58 and draws the metallic member 57 in direction "B". However when a substantial proportion of gas is present in the fuel the fluid flow in region 51 becomes turbulent, due to the gas breaking up the fluid flow. The venturi effect is destroyed with the pressure in the first chamber 52 increasing and the metallic member 57 moves in the direction "A" such that it moves into a recess 59. The recess 59 is positioned between two apertures 60 and 61 on the external surface of the gas detector 36 as can be seen more clearly from FIG. 4B. In aperture 60 there is inserted a piece of magnetic material 62, and in aperture 61 there is inserted a magnetically sensitive reed switch 63 connected by gland 64 to cable 65 which is connected to the computer 32 of FIG. 3. When substantially gas-free fuel is flowing through the detector 36 the metallic member 57 is located as shown in FIG. 4A, with the diaphragm 54 pulled from being flat in direction B. The magnetic field generated by magnetic member 62 causes the contacts in the reed switch 63 to be closed. When fuel flow stops, or gas is present, the vacuum in chamber 52 decreases and spring 58 urges the metallic member 57 into the recess 59 such that the reed switch 63 is shielded from the magnetic field, causing switch 63 to open.

To operate the fuel dispenser a pump attendant at the remote console 33 (FIG. 3) enables the dispenser, either after it had been shut down or after a previous transaction has been completed. An operator wishing to use the pump selects the grade of fuel he requires via user control 34 and removes nozzle 29 from nozzle cradle 30 activating the hose cock switch 31, in response to which the computer 32 activates pump 21. When gas-free fuel passes through the gas detector 36, the reed switch 63 closes, and the computer causes valve 27 to open permitting fuel to be dispensed via nozzle 29. Gas separated from the fuel via separator 23 and passing through gas detector 36 causes the reed switch 63 to open. The computer 32 records the duration for which the reed switch is open and uses this time, with information from the meter 26, to calculate whether the fuel dispensed meets metrological limits for the current transaction. If it is too close to such limits, the computer 32 partially shuts the valve 27 slowing the rate of fuel being dispensed providing the separator 23 with more time in which to separate the fuel. If this does not bring the transaction further back within the metrological limits the computer 32 shuts the valve 27 completely. Meanwhile gas in the system is purged by it passing through the gas detector 36 and pipe 38 to the sump 39 where it is vented. Any fuel accumulating in sump 39 is returned to the pump inlet 21. If within a predetermined time the gas detector 36 again changes state, indicating that substantially pure fuel, gas-free, is passing through it, the computer 32 reopens valve 27 and the transaction continues. However if gas continues to pass through the gas detector 36 for a period longer than the predetermined time the computer 32 stops the pump 21 and terminates the transaction. The computer 32 also transmits a signal to the control console 33 to draw the attendant's attention to the fact that the transaction had to be terminated.

In addition to the above functions, the computer also calculates the percentage of total operating time of the pump for which the gas detector indicates gas to be present. When this exceeds a predetermined percentage the service engineer is informed during the next service via display 35.

For volatile fuels, particularly but not exclusively petroleum spirit, it is advantageous to include a restriction 66 in the pipe 38 as shown in FIG. 3 of the accompanying drawing. Such an arrangement makes it possible to increase the sensitivity of the gas detector 36 for a given flow rate. This is particularly advantageous in hot climatic conditions where vapourisation of the fuel is more likely.

In the case of the pump 21 being a positive displacement type, the flow rate through pipe 38 will be unaffected by the restriction 66. When substantially gas-free fuel passes through the detector 36 the pressure at the outlet 50, and hence the pressure within the second chamber 55, will be increased. The effect however, upon the pressure in the first chamber 52 will be minimal because this is primarily dependent on the flow rate, which is unaffected. As a consequence for a given flow rate the pressure difference across the diaphragm 54 is increased. A greater pressure difference is therefore achieved without increasing the vacuum in chamber 52, which can be problematic in hot climates where this reduction in pressure could cause the fuel to vapourise. This vapourisation would otherwise limit the sensitivity of the detector by restricting the pressure that could be generated in the chamber 52, for any given maximum operating temperature and volatility of fuel. When there is gas present in the fuel the pressure in chamber 52 increases due to the gas breaking up the fluid flow between inlet 49 and exit hole 50 thereby destroying the Venturi effect. Furthermore when gas is present, in effect the viscosity of the fuel decreases and reduces the pressure at the restriction 66 such that the pressure in the chamber 55 is also reduced.

What we claim is:

1. A fuel dispenser comprising:

a gas detector for producing an electrical signal in dependence upon the presence of gas in fuel flowing through the chambers separated by a movable member, said first closed chamber having an inlet and an outlet, said second chamber being connected to said outlet by a passage, whereby fuel passing through said inlet and said outlet produces a reduction in pressure in said first chamber by the Venturi effect; and processing means for receiving the electrical signal and controlling the dispensing of fuel at least in part in dependence upon the electrical signal received.

2. A fuel dispenser as claimed in claim 1 further comprising a fuel separator including an inlet for receiving fuel and first and second outlets, wherein the first outlet is positioned such as to receive a greater proportion of gas than the second outlet, and wherein the gas detector receives fuel from the first outlet, and fuel for dispensing is received from the second outlet.

3. A fuel dispenser as claimed in claim 2 wherein fuel passing through the gas detector is recycled through the separator.

4. A fuel dispenser as claimed in claim 2 wherein fuel from the second outlet of the separator passes through a meter before being dispensed.

5. A fuel dispenser as claimed in claim 1, further comprising a vented reservoir, wherein fuel after passing through the gas detector, flow into said vented reservoir.

6. A fuel dispenser as claimed in claim 1 including a restriction in the outlet downstream from the connection to the passage.

7. A fuel dispenser as claimed in claim 1 wherein the gas detector comprises a metallic member attached to a movable member such that the metallic member moves into and out of a magnetic field between a magnetic source of the detector and a magnetically sensitive switching element in the casing of the detector for producing said electrical signal.

8. A fuel dispenser as claimed in claim 1 further comprising a nozzle through which fuel is dispensed, the nozzle being attached to a main body of the dispenser by a flexible hose, wherein the dispenser includes a cradle for the nozzle to be returned to when not in use, and a hose cock switch for transmitting a signal to the processing means indicative of the presence or absence of the nozzle in the cradle.

9. A fuel dispenser as claimed in claim 8 wherein once gas free fuel has been detected after the nozzle has been removed from the cradle the processing means causes a valve to open allowing fuel to be dispensed, and to cause the valve to close if gas is then detected.

10. A fuel dispenser as claimed in claim 9 wherein the processing means causes the valve to open again if gas-free fuel is again detected in a predetermined period after the initial closing of the valve and causes the valve to remain closed until the nozzle has been returned to its cradle if gas-free fuel is not detected in said period.

11. A fuel dispenser as claimed in claim 9, wherein the processing means records the duration for which gas is detected and uses this information to determine whether the fuel so far dispensed is within predetermined metrological limits for the amount of fuel so far dispensed in the transaction, and controls the valve accordingly.

12. A fuel dispenser as claimed in claim 9 wherein the valve has more than one setting permitting flow rate to be modified.

13. A fuel dispenser as claimed in claim 8 wherein the valve remains closed until the nozzle has been returned to the cradle.

14. A fuel dispenser as claimed in claim 1 wherein the processing means records the duration for which gas is detected and provides a warning if this exceeds a predetermined limit.

15. A gas detector for detecting the presence of gas in a fuel and providing an electrical signal output in dependence thereon, the detector comprising a first and a second closed chamber separated by a movable member, and an inlet and outlet in the first chamber of such dimensions and relative displacement that fuel passing through them produces a reduction in pressure in the first chamber by the Venturi effect, the second chamber being connected by a passage to the outlet.

16. A gas detector as claimed in claim 15 including a restriction in the outlet downstream from the connection to the passage.

17. A gas detector as claimed in claim 15 comprising a metallic member attached to a movable member which is adapted to be moved by the moveable member into and out of a magnetic field between a magnetic source of the detector and a magnetically sensitive switching element in the casing of the detector for producing said electrical signal.

18. A method of dispensing fuel comprising producing an electrical signal in dependence upon the presence of gas in fuel flowing through a gas detector, processing the electrical signal and controlling dispensing of fuel at least in part in dependence upon the electrical signal received.

19. A method as claimed in claim 18 including passing fuel into a fuel separator through an inlet, said fuel separator having first and second outlets wherein the first outlet is positioned such as to receive a greater proportion of gas than the second outlet, and passing fuel from the first outlet to the gas detector and receiving fuel for dispensing from the second outlet.

20. A method as claimed in claim 19 including recycling through the fuel separator the fuel passing through the gas detector.

21. A method as claimed in claim 19 including passing fuel from the second outlet of the separator through a meter prior to the fuel being dispensed.

22. A method as claimed in claim 21 including passing fuel from the gas detector into a vented reservoir.

23. A method as claimed in claim 18 including detecting the presence of gas by means of a venturi device.

24. A method as claimed in claim 18 wherein the gas detector comprises a first and a second closed chamber separated by a movable member, and an inlet and outlet in the first chamber of such dimensions and relative displacement that fuel passing through them produces a reduction in pressure in the first chamber by the Venturi effect, the second chamber being connected by a passage to the outlet.

25. A method as claimed in claim 24 including passing fuel through a restriction in the outlet downstream from the connection to the passage.

26. A method as claimed in claim 18 wherein the gas detector comprises a metallic member attached to a movable member such that the metallic member moves into and out of a magnetic field between a magnetic source of the detector and a magnetically sensitive switching element in the casing of the detector for producing said electrical signal.

27. A method as claimed in claim 18 further comprising dispensing fuel through a nozzle, the nozzle being attached to a main body of the dispenser by a flexible hose, wherein the dispenser includes a cradle for the nozzle to be returned to when not in use, and a hose cock switch for transmitting a signal to the processing means indicative of the presence or absence of the nozzle in the cradle.

28. A method as claimed in claim 27 wherein once gas free fuel has been detected after the nozzle has been removed from the cradle the processing means opens a valve allowing fuel to be dispensed, and closes the valve if gas is then detected.

29. A method as claimed in claim 28 wherein the processing means opens the valve again if gas-free fuel is again detected in a predetermined period after the initial closing of the valve and causes the valve to remain closed until the nozzle has been returned to its cradle if gas-free fuel is not detected in said period.

30. A method as claimed in claim 28, including recording the duration for which gas is detected and using this information to determine whether the fuel so far dispensed is within predetermined metrological limits for the amount of fuel so far dispensed in the transaction, and controlling the valve accordingly.

31. A method as claimed in claim 28 wherein the valve has more than one setting permitting flow rate to be modified.

32. A method as claimed in claim 27 wherein the valve remains closed until the nozzle has been returned to the cradle.

33. A method as claimed in claim 18 including recording the duration for which gas is detected and providing a warning if this exceeds a predetermined limit.

* * * * *